United States Patent [19]

House

[11] 4,435,117

[45] Mar. 6, 1984

[54] LIFT TRUCK PAPER ROLL CLAMP HAVING AUTOMATICALLY ADJUSTABLE ROLL OF DIFFERENT DIAMETERS

[75] Inventor: Marshall K. House, Portland, Oreg.

[73] Assignee: Cascade Corporation, Portland, Oreg.

[21] Appl. No.: 344,796

[22] Filed: Feb. 1, 1982

[51] Int. Cl.[3] ..... B66F 9/18

[52] U.S. Cl. ..... 414/620; 294/86 R; 294/106; 414/621; 414/911

[58] Field of Search ..... 414/619, 620, 621, 622, 414/623, 731, 911; 294/86 R, 88, 106

[56] References Cited

U.S. PATENT DOCUMENTS

| | | | |
|---|---|---|---|
| 2,596,477 | 5/1952 | Frischmann et al. | 414/620 |
| 2,959,310 | 11/1960 | Meister . | |
| 3,371,952 | 3/1968 | Hunger | 294/106 X |
| 3,782,567 | 1/1974 | Likas et al. | 294/106 X |
| 3,896,957 | 7/1975 | Sinclair | 414/911 X |
| 4,127,205 | 11/1978 | Farmer et al. | 414/911 X |

FOREIGN PATENT DOCUMENTS

| | | | |
|---|---|---|---|
| 1210535 | 2/1966 | Fed. Rep. of Germany | 294/106 |
| 2835447 | 2/1980 | Fed. Rep. of Germany . | |
| 558843 | 9/1977 | U.S.S.R. . | |

*Primary Examiner*—Leslie J. Paperner

*Attorney, Agent, or Firm*—Chernoff, Vilhauer, McClung, Birdwell & Stenzel

[57] ABSTRACT

A lift truck load clamp, for handling cylindrical loads such as paper rolls, having an automatically adjustable load positioner extending between the clamp arms which moves forwardly in response to closure of the clamp arms and rearwardly in response to opening thereof to assist the lift truck operator in positioning the clamp arms with respect to rolls of different diameters such that the contact pads of the clamp arms automatically grip such differently-sized rolls in diametrically-opposed relation. The load positioner is particularly adapted for use with clamps wherein both clamp arms are movable with respect to a clamp frame, because each end of the positioner is separately movable forwardly or rearwardly with respect to the frame in response to movement of the respective adjacent clamp arm. The positioner is also well adapted for use with clamps of the type wherein the clamp arms can be moved transversely in unison to handle a paper roll in different transverse positions, due to the fact that the load positioner is movable transversely in unison with the clamp arms. The positioner is flexibly conformable to the cylindrical surfaces of paper rolls of different diameters to avoid damage to the fragile surfaces thereof.

13 Claims, 3 Drawing Figures

LIFT TRUCK PAPER ROLL CLAMP HAVING AUTOMATICALLY ADJUSTABLE ROLL OF DIFFERENT DIAMETERS

BACKGROUND OF THE INVENTION

The present invention is directed to improvements in lift truck load clamps, of either the sliding or pivoted-arm type, for handling large rolls of paper such as newsprint and kraft paper.

Such clamps are normally required to handle paper rolls of widely-varying diameters in both vertical and horizontal orientations. A typical clamp comprises a pair of clamp arms either slidably or pivotally mounted upon a clamp frame and movable with respect to such frame selectively toward and away from each other to engage or release paper rolls of different diameters. Each clamp arm normally has a concave contact pad on the forwardly-extending tip thereof for engaging the cylindrical surface of the roll. For proper engagement, to ensure that the roll does not slip from the grasp of the clamp, it is important that the two contact pads engage the roll in substantially diametrically-opposed positions. This requires the lift truck operator to adjust the positions of the clamp arms relative to the roll prior to engagement such that the contact pads will neither underreach nor overreach the roll but rather will engage it in such diametrically-opposed positions. Because lift truck operators are normally hampered by visibility limitations imposed by the lift truck mast and clamp frame, it is often quite difficult for the operator to see the exact relationship between the contact pads and the roll. Particularly when rolls of different diameters are being handled, the operator is often forced to estimate roughly the proper positions of the contact pads with respect to a particular roll, resulting in inaccurate positioning of the contact pads and insecure engagement of the roll.

A solution to this problem has been proposed in Frischmann et al U.S. Pat. No. 2,596,477 which shows a paper roll clamp having a single pivoted clamp arm of substantial length and a fixed shorter clamp arm. The clamp includes an elongate load positioner having one end connected by a toggle and link assembly to the pivoted clamp arm so as to move forward automatically in response to closure of the pivoted clamp arm and move rearwardly automatically in response to opening thereof. The purpose is to ensure diametrically-opposed gripping of paper rolls of different diameters by the contact pads.

However, because the opposite end of the positioner is affixed pivotally to the clamp frame, the positioner is operable only with respect to a clamp having a single clamp arm movable with respect to the clamp frame. The positioner is not, for example, operative with respect to a clamp wherein both clamp arms are movable with respect to the clamp frame selectively toward and away from each other, or with respect to a clamp wherein both clamp arms are movable in unison transversely with respect to the clamp frame so as to handle a particular paper roll in different transverse positions.

Modern paper roll clamps such as those shown in U.S. Pat. Nos. 3,896,957 and 4,127,205, require movement of both clamp arms toward and away from each other relative to the clamp frame primarily to be able to handle small as well as large diameter rolls in a substantially centered position relative to the axis of rotation of the clamp rotator. Substantial centering of rolls of different diameters enables the rolls, when rotated to a vertical orientation, to be inserted into or extracted from an array of vertical paper rolls in close proximity to one another by permitting the clamp arms to slip between the closely adjacent rolls without damaging the fragile surfaces thereof.

The further ability of both clamp arms to be shifted transversely in unison with respect to the clamp frame is primarily needed to enable the clamp arms to engage a given paper roll both in a position of unequal extension, wherein the forward end of one clamp arm extends a greater distance forwardly of the lift truck than the forward end of the other clamp arm and, alternatively, in a position of equal extension wherein the forward ends of the clamp arms on either side of the paper roll extend a substantially equal distance forwardly of the lift truck. The unequal extension position is needed when a paper roll is lying in a horizontal orientation on the floor or other supporting surface, so that the upper clamp arm can overreach the lower clamp arm in order to assume substantially diametrically-opposed positions for grasping the roll firmly. Thereafter, if the paper roll is to be stacked vertically by rotating the clamp about its axis of rotation, the equal extension position is desirable to facilitate handling of the roll in close proximity to other vertically-oriented rolls.

In the aforementioned Frischmann et al clamp, if both of the clamp arms were movable with respect to the clamp frame, the load positioner's relationship to the clamp arms for diametrically-opposed roll engagement would change and thus become inoperative upon movement of the fixed clamp arm with respect to the clamp frame. This is because one end of the Frischmann et al load positioner is pivotally fixed to the clamp frame and therefore is not movable in response to the movement of the clamp arms toward and away from each other. The same problem would exist if the Frischmann et al clamp arms were capable of transverse movement in unison with respect to the clamp frame, since the fixed pivotal connection of one end of the load positioner with respect to the clamp frame would prevent the positioner from moving transversely in unison with the two clamp arms.

Other types of clamps having various load bumpers or positioners for loads of differing dimensions are shown in Russian Pat. No. 197,709, German published patent application No. 28 35 447, and U.S. Pat. Nos. 2,959,310 and 3,371,952. However none of these provide suitable solutions to the problems of paper roll clamps discussed above. Moreover such prior load positioners are inflexible and thus not conformable to cylindrical roll surfaces of different diameters, permitting relatively high impact stress when the lift truck is advanced forwardly into engagement between the load positioner and the load. This condition can cause excessive bearing force against the fragile paper roll surface and resultant costly damage to the outer layers of paper.

Accordingly what is needed is an automatically adjustable roll positioner, preferably of flexible construction, for ensuring diametrically-opposed engagement of paper rolls of different diameters which is operative with clamps wherein both clamp arms are movable with respect to a clamp frame, and wherein the clamp arms are movable transversely in unison with respect to the clamp frame.

SUMMARY OF THE PRESENT INVENTION

The present invention provides an automatically-adjustable paper roll positioner, capable of satisfying all of the above-described needs. The roll positioner comprises an elongate member, preferably of flexible strap-like construction, which extends generally transversely between the two clamp arms and has a pair of extremities, each of which is located adjacent a respective one of the clamp arms. Each extremity of the elongate roll positioner is movable forwardly with respect to the clamp frame automatically in response to movement of the respective clamp arm toward the other one of the clamp arms, and conversely is movable rearwardly automatically in response to movement of the respective clamp arm away from the other clamp arm. Since both extremities of the roll positioner are movable forwardly and rearwardly in response to closing and opening of the clamp arms, the roll positioner maintains a proper relationship to the arms for ensuring diametrically-opposed gripping of differently-sized paper rolls regardless of whether only one clamp arm moves with respect to the clamp frame to accomplish closing and opening or, alternatively, both arms move with respect to the clamp frame.

The preferable structure is one wherein each extremity of the transversely-oriented roll positioner is attached to a respective one of the clamp arms such that its forward and rearward movement respectively results directly from movement of the clamp arm. This arrangement is particularly well suited for a pivoted clamp arm structure wherein each extremity of the roll positioner is connected to an intermediate portion of each clamp arm which automatically moves forwardly with closing motion of the arm and rearwardly with opening motion thereof. Alternatively, with a sliding arm clamp, an equivalent linkage connected to each extremity of the roll positioner could be used to accomplish the same result.

The flexible, strap-like nature of the roll positioner renders it readily conformable to the cylindrical surfaces of paper rolls of different diameters, thereby maximizing the bearing surface area and correspondingly minimizing the bearing stress between the positioner and roll. This minimizes tearing, abrasion or cutting of the outer layers of the paper roll which might otherwise result from impact between the positioner and roll during maneuvering of the lift truck to engage the roll.

In the preferred embodiment, the extremities of the roll positioner move toward each other, as well as forwardly, in response to closure of the clamp arms. Accordingly provision is made for taking up excessive slack in the strap-like roll positioner which would otherwise occur in response to closure of the clamp arms. Although the slack could be taken up in any number of conventional ways, a unique structure for taking up and paying out flexible portions of the roll positioner strap in response to closing and opening of the clamp arms is conveniently integrated, according to the present invention, with the existing geometry of a pair of pivoted clamp arms.

Because both extremities of the roll positioner are movable in response to clamp arm movement relative to the clamp frame, the present invention also renders the roll positioner operative with clamps of the type wherein the clamp arms are movable transversely in unison with respect to the clamp frame. Thus, when both clamp arms are moved transversely in unison to center or decenter a paper roll, the roll positioner simply moves transversely with the clamp arms with no change in its relationship to the clamp arm contact pads. Accordingly the roll positioner of the present invention properly positions the clamp arm contact pads in diametrically-opposed relation to paper rolls of different diameters regardless of transverse shifting of the clamp arms relative to the lift truck.

Accordingly, it is a primary objective of the present invention to provide a paper roll clamp having an automatically adjustable roll positioner, for ensuring diametrically-opposed engagement of paper rolls of different diameters, which is operative with clamps wherein both clamp arms are movable with respect to a clamp frame.

It is a further objective of the present invention to provide a paper roll clamp having an automatically-adjustable roll positioner of a flexible construction rendering the positioner conformable to the cylindrical surfaces of paper rolls of different diameters so as to maximize the contact area and minimize the contact stress between the positioner and the roll.

It is a further objective of the present invention to provide a paper roll clamp having an automatically-adjustable roll positioner which is operative with clamps of the type wherein the clamp arms are movable transversely in unison with respect to the clamp frame by making the positioner likewise movable transversely in unison together with the clamp arms.

The foregoing and other objectives, features and advantages of the invention will be more readily understood upon consideration of the following detailed description of the invention, taken in conjunction with the accompanying drawings.

DESCRIPTION OF THE PREFERRED EMBODIMENT

Figure 1:
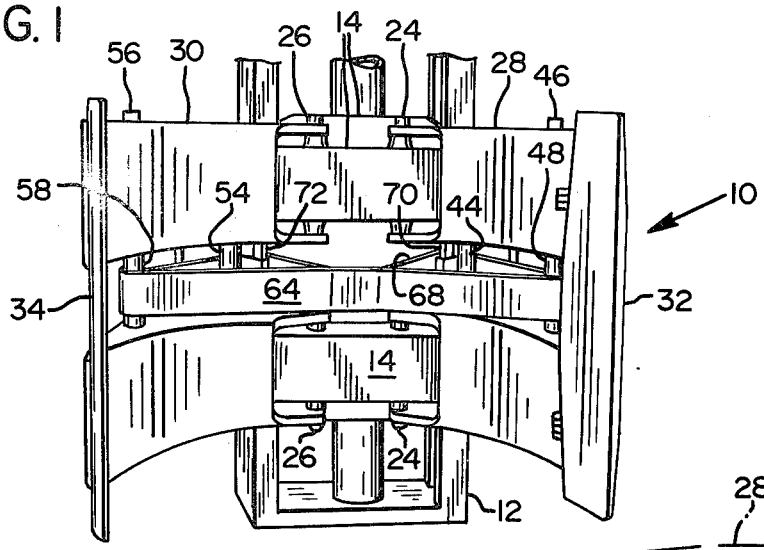
FIG. 1 is a perspective view of a paper roll clamp having a pair of pivoted clamp arms and an automatically-adjustable roll positioner in accordance with the present invention, such clamp being mounted on a lift truck mast and in a rotational position for handling vertically-oriented paper rolls.
Figure 2:
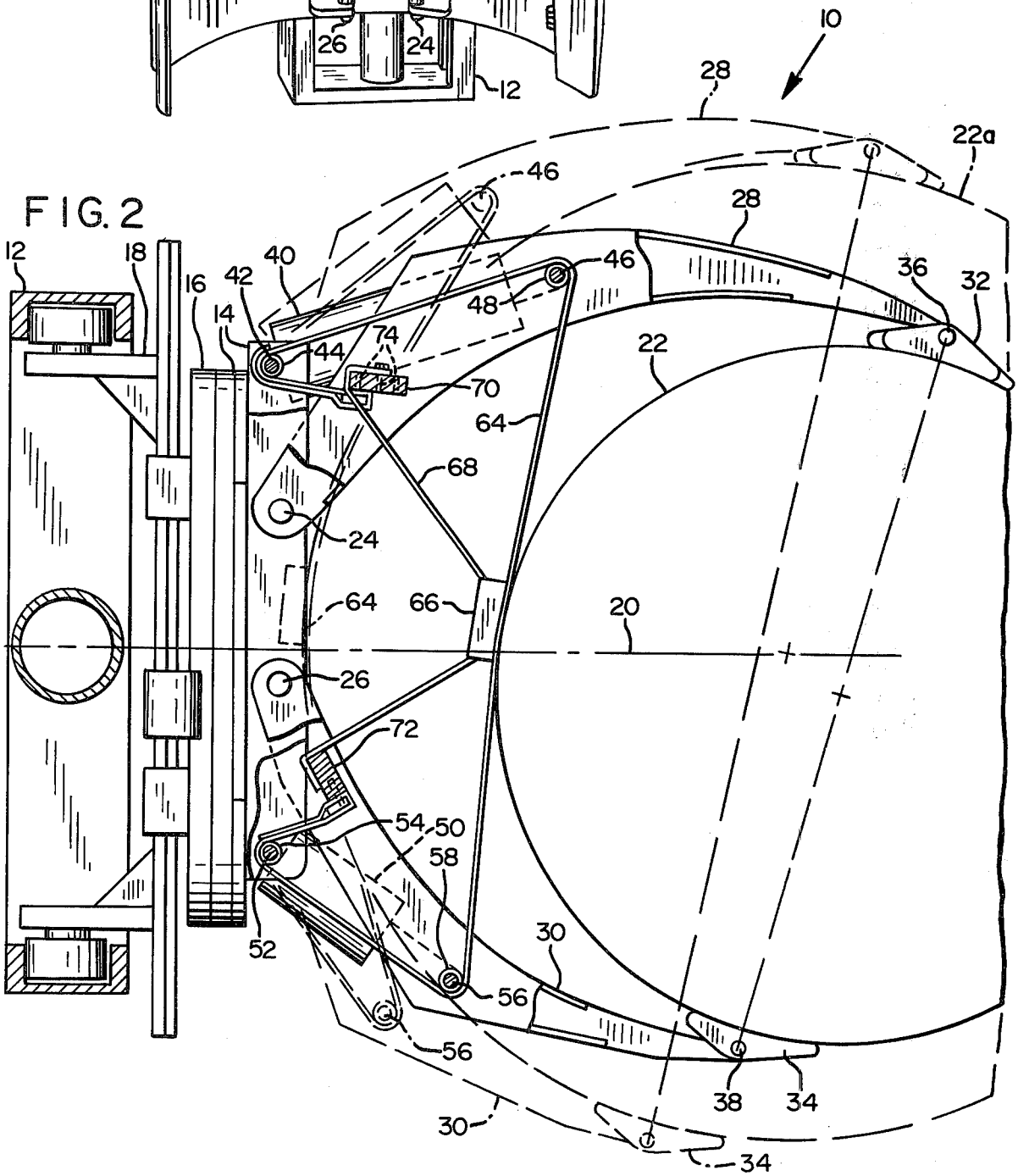
FIG. 2 is a partially-sectional top view of the paper roll clamp of FIG. 1 illustrating the clamp arms and roll positioner at different positions for handling paper rolls of different diameters.

With reference to FIGS. 1 and 2, an exemplary paper roll handling clamp designated generally as 10 is mounted on a mast 12 at the forward end of a lift truck (not shown). The clamp 10 has a clamp frame 14 which is rotatably mounted by means of a rotator 16 upon a carriage 18 which moves vertically selectively upward or downward on the mast 12. The rotator 16 provides powered rotation of the clamp frame 14 about an axis of rotation 20 extending generally forwardly from the mast 12 and carriage 18 along the longitudinal centerline of the lift truck. Such rotation permits the clamp 10 to handle paper rolls such as 22 and **22*a*** both in a horizontal orientation or, alternatively, in a vertical orientation as shown in FIG. 2.

The clamp frame 14 mounts respective pairs of transversely-extending, axially-aligned pivot pins 24 and 26 respectively. Pivotally mounted upon the frame 14 by pivot pins 24 is a forwardly-projecting, selectively openable and closable clamp arm 28, while an opposing clamp arm 30 is pivotally mounted on the frame 14 by means of pins 26. Each clamp arm is equipped with a respective paper roll engaging arcuate contact pad 32, 34 defining the forward tip of the respective clamp arm 28, 30. Each contact pad is hingedly connected to the remainder of the clamp arm by a respective hinge 36, 38.

Clamp arm 28 is pivotable angularly with respect to the clamp frame 14 selectively toward and away from the other clamp arm 30 by the selective extension and retraction of a pair of double-acting hydraulic ram assemblies 40 (only one of which is shown in FIG. 2) pivotally connected to the frame 14 at their bases by a common vertically-extending pin 42 having a roller 44 rotatably mounted about a midportion thereof. The ram assemblies 40 are connected at their forward ends to the clamp arm 28 by a vertically-extending common pin 46 likewise having a roller 48 rotatably mounted about a midportion thereof.

Clamp arm 30 is similarly selectively pivotable angularly with respect to frame 14 by a pair of double-acting hydraulic ram assemblies 50 (only one of which is shown in FIG. 2) pivotally connected at their bases to the frame 14 by a common vertically-extending pin 52 having a roller 54 rotatably mounted about a midportion thereof. The forward ends of ram assemblies 50 are connected to the clamp arm 30 by a common vertically-extending pin 56 having a roller 58 rotatably mounted about a midportion thereof.

Each of the clamp arms 28, 30 has a respective roll positioner anchor bar 70, 72 affixed thereto, to each of which is affixed a respective end of an elongate flexible strap 64, constructed of a suitable material such as a nylon woven web of the type used for lifting slings. From each of the anchor bars 70, 72, the strap 64 is reeved first about a respective roller 44, 54 on the frame 14 and then around a respective roller 48, 58 on the respective clamp arms 28, 30, crossing transversely between the rollers 48 and 58. The operative part of the strap constituting the roll positioner is the portion extending transversely between the rollers 48 and 58, such rollers 48 and 58 defining the two extremities of the roll positioner and the remaining portions of the strap 64 comprising structure for preventing excessive slack in the strap by selectively taking up and paying out portions of the strap as the clamp arms move toward and away from each other respectively.

In operation, it can be seen from FIG. 2 that each extremity of the roll positioner portion of the strap 64, as defined by the rollers 48 and 58 respectively, moves forwardly with respect to the clamp frame 14 automatically in response to movement of its respective clamp arm toward the other clamp arm, and conversely moves rearwardly in response to movement of its clamp arm away from the other clamp arm. This occurs whether or not the clamp arms move toward or away from each other concurrently.

When a roll of smaller diameter such as roll 22 in FIG. 2 is to be grasped, the portion of the strap 64 between the rollers 48 and 58 moves forwardly toward the position shown in solid lines in FIG. 2 as the clamp arms close toward one another to a point where their contact pads are separated by a distance slightly greater than the diameter of the roll 22. The position of the portion of the strap 64 extending between the rollers 48 and 58 is such that it will abut the rear surface of the paper roll 22 when the contact pads 32 and 36 are in substantially-diametrically-opposed relation for proper gripping of the roll, thereby automatically positioning the clamp arms with respect to the roll.

Conversely, if a larger roll such as that indicated as *22a* in FIG. 2 is to be grasped, the clamp arms 28 and 30 are pivoted away from each other to the positions shown in phantom in FIG. 2, thereby moving the rollers 48 and 58 rearwardly with respect to the clamp frame 14. It will be noted that such movement of the clamp arms 28 and 30 away from each other moves the anchor bars 70 and 72 substantially closer to the pins 42 and 52 and their respective rollers 44 and 54, and also moves the rollers 48 and 58 closer to the rollers 44 and 54 respectively, thereby paying out additional portions of strap 64. Some of the quantity of strap paid out is needed to accommodate the wider separation of pins 48 and 58, but a greater amount of slack in the operative portion of the strap 64 also results, thereby allowing the portion of the strap 64 between the rollers 48 and 58 to bow to a greater degree than in the position of the clamp arms previously discussed. The more rearward position of the operative portion of the strap 64 as shown in phantom in FIG. 2, resulting from the opening of the clamp arms 28 and 30 to handle the larger roll *22a*, is appropriate to permit the contact pads to engage the larger roll in diametrically-opposed relation.

The operative portion of the strap 64 has a loop of material 66 on the rear side thereof through which are stretched a vertically spaced pair of resilient elastomer bands 68 of any suitable type, anchored at each end to the respective anchor bars 70 and 72. The elastomer bands 68, only one of which is shown, bias the flexible operative portion of the strap 64 between the rollers 48 and 58 to a generally concave forwardly-facing configuration in the various clamp arm positions.

Anchor bar 70 has several alternative mounting screw apertures 74 by which the length of the strap 64 may be adjusted.

Figure 3:
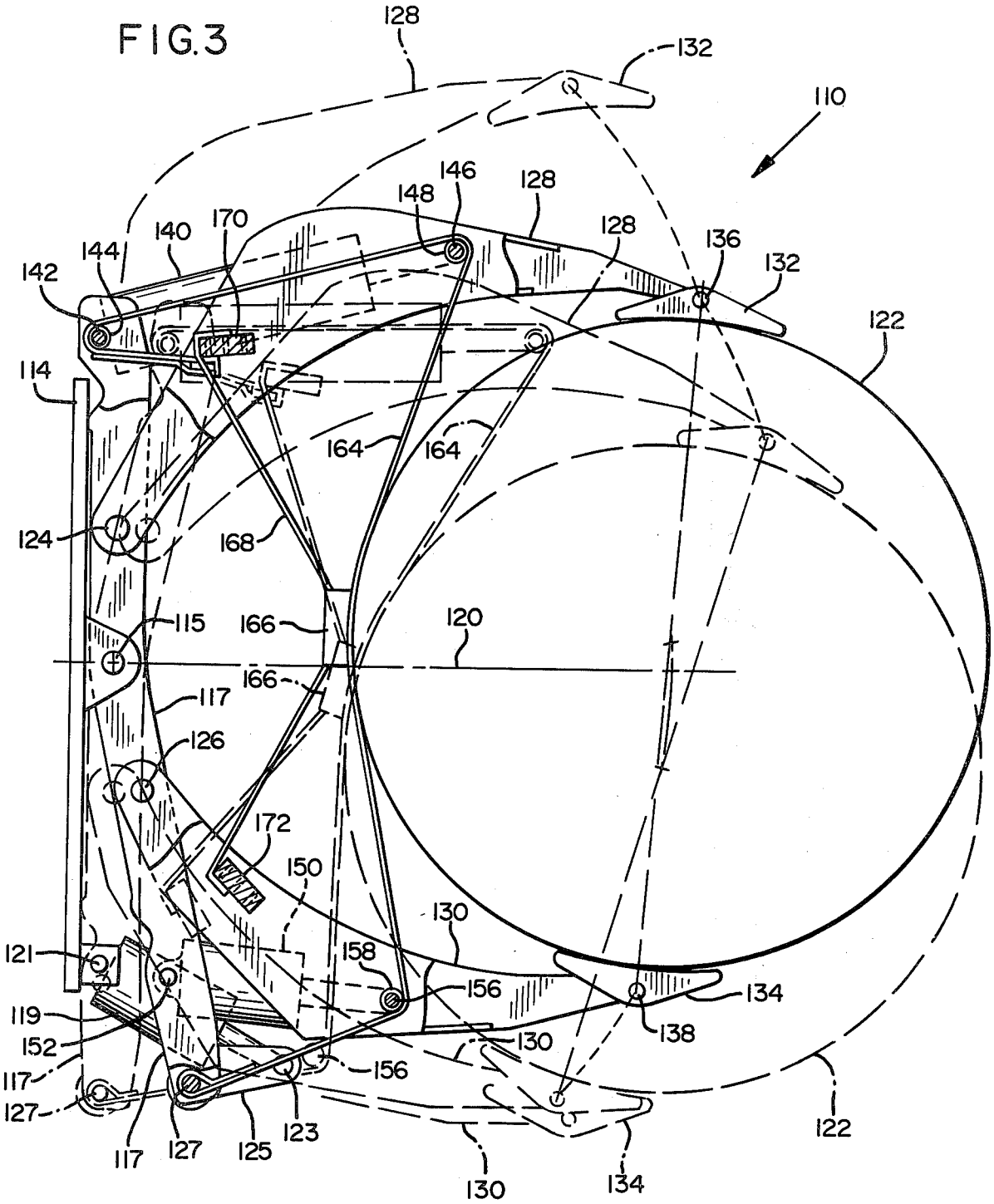
FIG. 3 is a partially sectional top view of a further embodiment of a pivoted arm paper roll clamp in a rotational position for handling vertically-oriented rolls, such clamp being of the type capable of moving the clamp arms transversely in unison and depicting operation of the roll positioner of the present invention in conjunction therewith.

FIG. 3 depicts a variation of the pivoted arm clamp of FIGS. 1 and 2 which is capable not only of moving both clamp arms toward and away from each other with respect to the clamp frame, but in addition is capable of moving the clamp arms in unison transversely so as to shift the position of a particular paper roll transversely with respect to the lift truck. This particular embodiment of a pivoted arm paper roll clamp, designated generally as 110, is also mounted on a mast at the forward end of a lift truck (not shown). The clamp 110 has a clamp frame 114 which is rotatably mounted similarly to clamp frame 14 of the embodiment of FIGS. 1 and 2 so as to provide powered rotation of the clamp frame 114 about a forwardly-extending axis of rotation 120.

Pivotally mounted upon the clamp frame 114 by means of a pair of axially-aligned pins 115 (only one of which is shown in FIG. 3) is a subframe 117. Pins 115 permit the subframe 117 to pivot with respect to the clamp frame 114 about a pivot axis extending transverse to the axis of rotation 120 in response to the selective extension or retraction of a double-acting hydraulic ram assembly 119 located midway between the top and bottom of the clamp in its rotational orientation as shown in FIG. 3. The ram assembly 119 is pivotally connected at its base by a pin 121 to the clamp frame 114 and pivotally connected at its opposite end to the subframe 117 by a pin 123 mounted in a lever-shaped member 125 which is rigidly connected by pins 127 and 152 respectively to the subframe 117 so as to constitute a rigid part thereof.

The subframe 117 includes two portions extending transversely in each direction from the pivot pins 115, each portion mounting respective pairs of transversely-extending, axially-aligned pivot pins 124 and 126 respectively. Pivotally mounted upon the subframe 117 by pivot pins 124 is a forwardly-porjecting, selectively openable and closable clamp arm 128, while an opposing clamp arm 130 is pivotally mounted on the subframe 117 by means of pins 126. Each clamp arm is equiped with a respective paper roll engaging arcuate contact pad 132, 134 at the forward tip of the respective clamp arm 128, 130. Each contact pad is hingedly connected to the remainder of the clamp arm by a respective hinge 136, 138.

Clamp arm 128 is pivotable angularly with respect to the subframe 117 selectively toward and away from the other clamp arm 130 by the selective extension and retraction of a pair of vertically-spaced double-acting hydraulic ram assemblies 140 (only one of which is shown in FIG. 3). Ram assemblies 140 are pivotally connected to the subframe 117 at their bases by a common vertically-extending pin 142 having a roller 144 rotatably mounted about a midportion of the pin 142 between the vertically-spaced ram assemblies 140. The forward ends of the ram assemblies 140 are similarly pivotally connected to the clamp arm 128 by a vertically-extending common pin 146 having a roller 148 rotatably mounted on a midportion thereof.

Clamp arm 130 is selectively pivotable angularly with respect to subframe 117 toward and away from clamp arm 128 by a pair of hydraulic ram assemblies 150 (only one of which is shown in FIG. 3) vertically spaced on either side of ram assembly 119 and pivotally connected at their bases to the subframe 117 by a pair of vertically-spaced, axially-aligned pins 152 and at their forward ends to the clamp arm 130 by a common vertically-extending pin 156 having a roller 158 rotatably mounted about a midportion thereof.

The function of the subframe 117 is to enable the clamp arms 128 and 130 to be moved transversely in unison so as to shift a paper roll, such as 122, between different transverse positions relative to the clamp frame 114 and lift truck. The positions of the clamp arms 128 and 130 and the paper roll 122 shown in solid lines in FIG. 3 result from extension of the ram assemblY 119 which tilts the subframe 117 and thus the clamp arms 128 and 130 in unison with respect to the clamp frame 114, moving the clamp arms to positions of substantially equal extension forwardly of the lift truck with the center of gravity of the roll 122 substantially centered on the rotational axis 120 of the clamp. Conversely, retraction of the ram assembly 119 tilts the subframe 117 and clamp arms 128 and 130 to an opposite position shown in phantom in FIG. 3 wherein the clamp arms are in positions of substantially unequal extension forwardly of the lift truck and the center of gravity of the paper roll 122 is substantially decentered from the clamp's rotational axis 120. This position of unequal extension is desirable for engaging horizontally-oriented paper rolls resting on a supporting surface, while the position of equal extension is desirable for handling vertically-oriented rolls as explained previously.

Clamp arm 128 has a roll positioner anchor bar 170 affixed thereto, to which is adjustably affixed an end of an elongate flexible strap 164 similar to strap 64 described previously. From anchor bar 170 the strap 164 is reeved first around roller 144 on the subframe 117 and then around roller 148 on the clamp arm 128, thereafter crossing transversely between the clamp arms to the opposite roller 158 on clamp arm 130 after which it is anchored to pin 127. The operative part of the strap constituting the roll positioner is the portion extending transversely between the rollers 148 and 158, such rollers defining the two extremities of the roll positioner as explained with respect to the embodiment of FIGS. 1 and 2. As in the previous embodiment, the remaining portions of the strap 164 constitute structure for preventing excessive slack in the strap by selectively taking up and paying out portions of the strap as the clamp arms move toward and away from each other respectively. A pair of elastomer bands 168, only one of which is shown, passing through a loop 166 on the rear side of the strap 164 serves the same function as described previously with respect to elastomer bands 68. One end of each elastomer band 168 is adjustably affixed to the anchor bar 170 of clamp arm 128, while the opposite end is affixed to anchor bar 172 of clamp arm 130.

As can be seen from FIG. 3, transverse movement of the arms 128 and 130 in unison by the selective extension or retraction of ram assembly 119 and the resultant tilting of subframe 117 likewise moves the roll positioner strap 164 in unison with the clamp arms, thereby retaining it in its proper operational relationship to the clamp arms despite such transverse movement thereof.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-handling clamp adapted to be mounted upon the lifting apparatus at the forward end of a lift truck for engaging a cylindrical load such as a roll of paper and the like, comprising:

(a) a frame adapted to be mounted upon said lifting apparatus so as to be selectively movable vertically by said lifting apparatus;

(b) a pair of selectively openable and closable opposing clamp arms mounted upon said frame projecting therefrom in a forward direction, each of said clamp arms having a forward tip for engaging a load;

(c) means movably connecting each of said clamp arms to said frame for permitting each of said clamp arms to move with respect to said frame selectively toward and away from the other of said clamp arms;

(d) clamp arm power means connecting said clamp arms with said frame for selectively moving each of said clamp arms with respect to said frame toward and away from the other of said clamp arms;

(e) a load positioner comprising an elongate member extending between said clamp arms generally transversely to said forward direction and having a pair of extremities, each of said extremities being located adjacent a respective one of said clamp arms; and (f) respective means adjacent each of said extremities for selectively moving each respective extremity forwardly with respect to said frame automatically in response to movement of the respective adjacent clamp arm toward the other one of said clamp arms, and for moving each respective extremity rearwardly with respect to said frame automatically in response to movement of the respective adjacent clamp arm away from the other one of said clamp arms, said respective means including means for moving said elongate member to different positions, automatically variably dependent upon the relative positions of said clamp arms with respect to each other, for forcibly abutting a cylindrical load located between the forward tips of said clamp arms prior to the engagement of said load by said tips and, by such abutment, ensuring that said tips are in substantially diametrically opposed relation to said load when said tips are separated by a distance substantially equal to the diameter of said load.

2. The load-handling clamp of claim 1 wherein said means movably connecting each of said clamp arms to said frame includes pivotal connection means for connecting a rear portion of each of said clamp arms pivotally to said frame, each of said pair of extremities of said elongate member being connected to a respective one of said clamp arms at a position between the forward tip of the respective clamp arm and said pivotal connection means.

3. The load-handling clamp of claim 1 wherein said respective means adjacent each of said extremities of said elongate member includes means for moving each respective extremity toward the other extremity as the respective extremity moves forwardly with respect to said frame, and for moving each respective extremity away from the other extremity as the respective extremity moves rearwardly with respect to said frame.

4. The load-handling clamp of claim 2 or 3 wherein said load positioner comprises a flexible elongate member, further including means for taking up slack between said extremities of said flexible elongate member during relative movement of said clamp arms with respect to each other.

5. The load-handling clamp of claim 4 wherein said means for taking up slack comprises means adjacent at least one extremity of said elongate member for selectively taking up and paying out flexible portions of said elongate member in response to relative movement of said clamp arms toward and away from each other respectively.

6. The load-handling clamp of claim 5 wherein said means for taking up slack comprises a flexible portion of said elongate member having an end fixedly attached to a first portion of a respective clamp arm and reeved movably around a portion of said frame and around a second portion of said respective clamp arm and extending from said second portion toward the other of said clamp arms.

7. The load-handling clamp of claim 1, further including means for moving said clamp arms and said load positioner in unison with respect to said frame in a direction generally transverse to said forward direction while maintaining said clamp arms a predetermined spaced distance from each other.

8. A load-handling clamp adapted to be mounted upon the lifting apparatus at the forward end of a lift truck for engaging a cylindrical load such as a roll of paper and the like, comprising:

(a) a frame adapted to be mounted upon said lifting apparatus so as to be selectively movable vertically by said lifting apparatus;

(b) a pair of selectively openable and closable opposing clamp arms mounted upon said frame projecting therefrom in a forward direction, each of said clamp arms having a forward tip for engaging a load;

(c) means movably connecting a respective clamp arm to said frame for permitting said respective clamp arm to move with respect to said frame selectively toward and away from the other of said clamp arms;

(d) clamp arm power means connecting said respective clamp arm with said frame for selectively moving said respective clamp arm with respect to said frame toward and away from the other of said clamp arms;

(e) load positioner means, located between said clamp arms and automatically responsive to the movement of said respective clamp arm, for moving forwardly with respect to said frame automatically in response to the movement of said respective clamp arm toward the other of said clamp arms and for moving rearwardly with respect to said frame automatically in response to the movement of said respective clamp arm away from the other of said clamp arms;

(f) said load positioner means comprising a flexible elongate member flexibly conformable to the curved surfaces of cylindrical loads of different diameters, said flexible elongate member having a pair of extremities;

(g) means at a respective extremity of said flexible elongate member for moving said respective extremity toward the other extremity as said load positioner means moves forwardly with respect to said frame and for moving said respective extremity away from the other extremity as said load positioner means moves rearwardly with respect to said frame; and (h) means for taking up and paying out between said extremities different flexible portions of said elongate member, automatically variably dependent upon the relative position of said respective clamp arm with respect to the other of said clamp arms, for causing said flexible elongate member to forcibly abut a cylindrical load located between the forward tips of said clamp arms prior to the engagement of said load by said tips and, by such abutment, ensuring that said tips are in substantially diametrically opposed relation to said load when said tips are separated by a distance substantially equal to the diameter of said load.

9. The load-handling clamp of claim 8 wherein said means for taking up slack comprises a flexible portion of said elongate member having an end fixedly attached to a first portion of a respective clamp arm and reeved movably around a portion of said frame and around a second portion of said respective clamp arm and extending from said second portion toward the other of said clamp arms.

10. The load-handling clamp of claim 8 including resilient biasing means for biasing said flexible elongate member to a generally concave forwardly-facing configuration.

11. A load-handling clamp adapted to be mounted upon the lifting apparatus at the forward end of a lift truck for engaging a cylindrical load such as a roll of paper and the like, comprising:

(a) a frame adapted to be mounted upon said lifting apparatus so as to be selectively movable vertically by said lifting apparatus;

(b) a pair of selectively openable and closable opposing clamp arms mounted upon said frame projecting therefrom in a forward direction, each of said clamp arms having a forward tip for engaging a load;

(c) means movably connecting a respective clamp arm to said frame for permitting said respective clamp arm to move with respect to said frame selectively toward and away from the other of said clamp arms;

(d) clamp arm power means connecting said respective clamp arm with said frame for selectively moving said respective clamp arm with respect to said frame toward and away from the other of said clamp arms;

(e) load positioner means, located between said clamp arms and automatically responsive to the movement of said respective clamp arm, for moving forwardly with respect to said frame automatically in response to the movement of said respective clamp arm toward the other of said clamp arms and for moving rearwardly with respect to said frame automatically in response to the movement of said respective clamp arm away from the other of said clamp arms;

(f) means for moving said load positioner means to different positions, automatically variably dependent upon the relative position of said respective clamp arm with respect to the other of said clamp arms, for forcibly abutting a cylindrical load located between the forward tips of said clamp arms prior to the engagement of said load by said tips and, by such abutment, ensuring that said tips are in substantially diametrically opposed relation to said load when said tips are separated by a distance substantially equal to the diameter of said load; and (g) means for moving said clamp arms and said load positioner means in unison with respect to said frame in a direction generally transverse to said forward direction while maintaining said forward tips of said clamp arms a predetermined spaced distance from each other.

12. The load-handling clamp of claim 11 wherein said means for moving said clamp arms and said load positioner means in unison comprises means for moving said clamp arms between a position of equal extension, wherein the forward tips of said clamp arms are spaced apart from each other by a predetermined distance and extend a substantially equal distance forwardly of said frame, and a position of unequal extension, wherein the forward tips of said clamp arms are spaced apart from each other by said predetermined distance and the forward tip of one clamp arm extends a greater distance forwardly of said frame than the forward tip of the other clamp arm.

13. The load-handling clamp of claim 11 or 14 wherein said load positioner means comprises an elongate member extending between said clamp arms generally transversely to said forward direction and having a pair of extremities, each of said extremities being connected to a respective clamp arm so as to be movable in unison therewith as said clamp arms move in unison with respect to said frame.

* * * * *

UNITED STATES PATENT AND TRADEMARK OFFICE

CERTIFICATE OF CORRECTION

PATENT NO. : 4,435,117

DATED : March 6, 1984

INVENTOR(S) : Marshall K. House

It is certified that error appears in the above-identified patent and that said Letters Patent are hereby corrected as shown below:

| | |
|---|---|
| In the Title: | After "ROLL" insert the words --POSITIONER FOR ENGAGING ROLLS--. |
| Col. 7, line 13 | Change "forwardly-porjecting" to --forwardly-projecting--. |
| Col. 7, lines 52-53 | Change "assemblY" to --assembly--. |
| Col. 12, line 29 | Change "14" to --12--. |

Signed and Sealed this

*Twenty-sixth* Day of *June 1984*

[SEAL]

*Attest:*

GERALD J. MOSSINGHOFF

*Attesting Officer*

*Commissioner of Patents and Trademarks*